US005213247A

United States Patent [19]

Gschwend et al.

[11] Patent Number: 5,213,247

[45] Date of Patent: May 25, 1993

[54] INTERNAL COMBUSTION POWERED TOOL FOR DRIVING FASTENING ELEMENTS

[75] Inventors: Hans Gschwend, Mauren, Switzerland; Markus Sprenger, Eschen, Liechtenstein

[73] Assignee: Hilti Aktiengesellschaft, Liechtenstein

[21] Appl. No.: 775,704

[22] Filed: Oct. 10, 1991

[30] Foreign Application Priority Data

Oct. 11, 1990 [DE] Fed. Rep. of Germany ..... 4032204

[51] Int. Cl.[5] ..... B25C 1/08

[52] U.S. Cl. ..... 227/10; 227/8

[58] Field of Search ..... 227/8, 9, 10, 11; 123/46 SC, 48 C; 60/633

[56] References Cited

U.S. PATENT DOCUMENTS

| | | | |
|---|---|---|---|
| 4,200,213 | 4/1980 | Liesse | 227/10 |
| 4,405,072 | 9/1983 | Kindle et al. | 227/10 |
| 4,712,379 | 12/1987 | Adams et al. | 60/633 X |
| 4,717,060 | 1/1988 | Cotta | 227/10 |
| 4,721,240 | 1/1988 | Cotta | 227/10 |
| 4,759,318 | 7/1988 | Adams | 123/46 SC |
| 4,773,581 | 9/1988 | Ohtsu et al. | 227/10 |

*Primary Examiner*—Douglas D. Watts
*Assistant Examiner*—Rinaldi Rada
*Attorney, Agent, or Firm*—Anderson Kill Olick & Oshinsky

[57] ABSTRACT

A portable, internal combustion power operated working device, such as a setting tool for driving fastening elements into a receiving material, has a combustion chamber (9) for burning an air-fuel mixture. A piston (7, 7a), guided within a guide cylinder (8), is driven by the gas pressure generated by the combustion of the air-fuel mixture. The combustion chamber volume can be varied by at least one displaceable combustion chamber wall (11). To prepare the air-fuel mixture, a metering chamber (67) holds a predetermined quantity of gaseous fuel. Fuel from the metering chamber along with air is drawn into the combustion chamber by a negative pressure produced in the combustion chamber when the combustion chamber volume is increased by displacing the at least one combustion chamber wall (11).

8 Claims, 9 Drawing Sheets

INTERNAL COMBUSTION POWERED TOOL FOR DRIVING FASTENING ELEMENTS

BACKGROUND OF THE INVENTION

The present invention is directed to a portable, internal combustion power operated working device, such as a tool for driving fastening elements into a receiving material. The working device includes a housing containing a combustion chamber with a piston guided within a guide chamber with the guide chamber displaceably mounted in the combustion chamber. The piston can be driven axially within the guide chamber by gas pressure generated by combustion of an air-fuel mixture within the combustion chamber. Means are provided for preparing the air-fuel mixture to be supplied to the combustion chamber.

Such a working device is known from the U.S. Pat. No. 4,759,318.

The known working device includes a combustion chamber for burning an air-fuel mixture, and a piston guided in a guide cylinder and driven by the gas pressure generated by the combustion of an air-fuel mixture. In addition, there is an arrangement for preparing the air-fuel mixture.

If this known working device is to be operated, first air must be pumped into the combustion chamber by a separate pumping apparatus located in the handle of the device and operated manually for forming the air-fuel mixture along with the injected fuel. Particularly in a large volume device, an adequate turbulence of the air-fuel mixture is not assured, and, in addition, considerable output fluctuations develop, due to the injection of liquid gas, independent of the ambient pressure, into the combustion chamber.

SUMMARY OF THE INVENTION

Therefore, the primary object of the present is to provide a working device, of the type mentioned above, where output fluctuations causing ignition failure are avoided. Such fluctuations may be caused by insufficient mixing of air and fuel or by defective metering of the fuel.

In accordance with the present invention, the volume of the combustion chamber is variable by displacement of at least one combustion chamber wall. Further, a metering chamber is provided for supplying a predetermined quantity of the gaseous fuel into the combustion chamber.

Air as well as gaseous fuel can be drawn into the combustion chamber by a negative pressure, and the negative pressure is produced in the combustion chamber by increasing its volume.

In the working device of the present invention the air-fuel mixture can be drawn into the combustion chamber by enlarging the combustion chamber volume and thereby developing the negative pressure. Further, gaseous fuel is drawn from the metering chamber which has a specific volume. As a result, the combustion chamber is always supplied with a constant quantity of gaseous fuel. The fuel is drawn out of the metering chamber, because of the negative pressure within the combustion chamber, and is given a turbulent flow in a channel where the air is drawn into the chamber, so that a uniform air-fuel mixture is obtained in the combustion chamber.

In a preferred embodiment of the invention, the gaseous fuel is obtained by evaporation of an apportioned quantity of liquid gas in an apportioning chamber, with the gas being supplied to such chamber from a container holding liquified gas. Accordingly, the metering chamber is located downstream of the apportioning chamber.

To be capable of always supplying a constant share of gaseous fuel into the combustion chamber, initially a quantity of liquid gas is supplied into an apportioning chamber, and this chamber is connected via a valve arrangement with the liquified gas container. A quantity of liquid gas flows out of the apportioning chamber through an outlet valve and is evaporated. The gaseous fuel fills a metering chamber or causes the metering chamber to expand to a predetermined volume. This feature can be achieved by a piston displaceably supported in the metering chamber. As a result, the metering chamber always provides a constant share of gaseous fuel, so that a constant pressure is generated each time the air-fuel mixture is ignited in the combustion chamber.

If the working device is pressed against or lifted off a structural component into which a fastening element is to be driven, a rod projecting axially forwardly of the working device can be pressed rearwardly into or pressed forwardly out of the device, whereby when the rod is pressed into the device a liquid gas container outlet closes and an apportioning outlet is opened, while if the rod is pressed out of the device, the apportioning chamber outlet chamber closes and the liquid gas container outlet opens.

When the working device is pressed against a structural component, a valve between the apportioning chamber and the liquid gas container is shut, and a valve between the apportioning and the metering chamber is opened. Accordingly, only the amount of liquid gas, previously accumulated in the apportioning chamber can evaporate. When the working device is removed from the component, the apportioning chamber is again filled with liquid gas, however, this quantity of liquid gas can not evaporate and flow to the metering chamber. The evaporation step occurs only after the commencement of the next working operation.

In accordance with a very advantageous embodiment of the invention, the metering chamber is connected for a short period of time to the ambient atmosphere over a pressure compensation channel before filling the combustion chamber with the air-fuel mixture.

Depending on the ambient pressure, the metering chamber supplies a more or less large share of gaseous fuel, so that when the ambient air is drawn in, the air-fuel mixture is formed whereby a constant ratio between the air drawn in and the gaseous quantity of fuel is obtained. As a result, the working device always produces a constant pressure within the combustion chamber though it is used at different altitudes and at different ambient pressures and temperatures.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
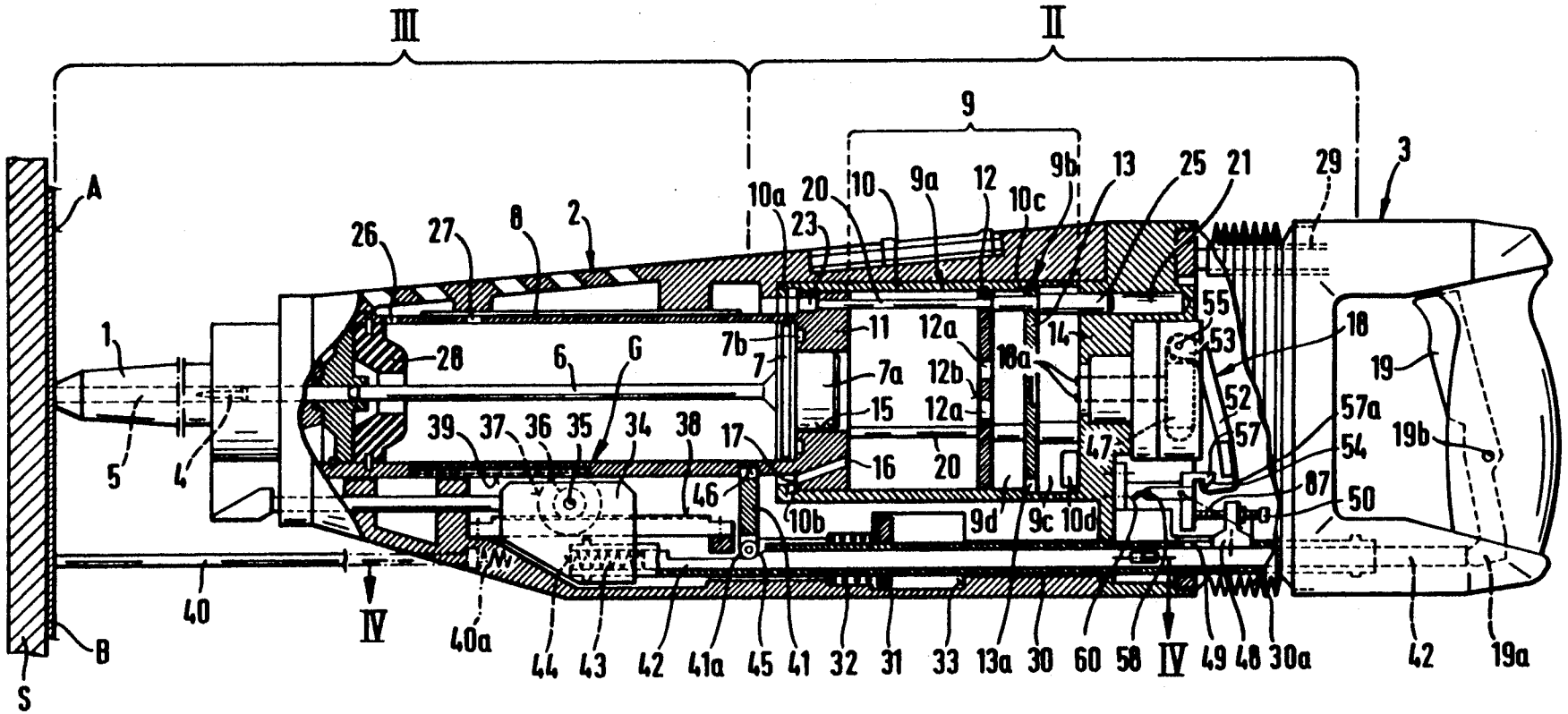
FIG. 1 is an axially extending diagrammatic sectional view through a working device embodying the present invention.

The working device embodying the present invention, as shown in FIG. 1, can drive fastening elements, such as nails, bolts and the like, directly into receiving materials, such as wood, steel, concrete and the like. As viewed in the drawing, the front end of the device is at the left and its rear end is at the right, accordingly each of the parts of the device has a front end facing toward the left and a rear end facing toward the right in the drawing.

In FIG. 1 the working device includes a first housing part 2 forming the front and major portion of the device with a muzzle part 1 extending axially outwardly from the front end of the housing part 2. A second housing part 3 forms the rear end of the device and extends rearwardly from the rear end of the housing part 2. The first and second housing parts 2, 3 are connected to one another and are displaceable in the front-rear direction, that is the setting or axial direction of the device, with respect to one another. The second housing part 3 has a handle.

In use, the muzzle part 1 of the working device is pressed against a surface A of a structural component B for driving a fastening element 4, such as a nail, through the component B into the structural member S. In FIG. 1, the nail 4 is shown located within an axially extending barrel 5 in the muzzle part 1. The fastening element is driven by a driver or shank 6 which contacts the head end of the fastening element. The shank 6 is fixed to and extends axially forwardly from a piston 7. Piston 7 is located within and is guided by an axially extending guide cylinder 8 mounted within the first housing part 2 so that it is movable in the axial direction of the cylinder.

As shown in FIG. 1, the surface A is formed by a surface of a metal plate B to be secured on a structural member, such as a steel girder S. Accordingly, the fastening element 4 is driven through the plate B into the steel girder S.

After it is driven, the head of the fastening element 4 bears against the surface A of the plate B and presses the plate against the steel girder S.

At the rear end of the guide cylinder 8 there is an axially extending combustion chamber 9 where a air-fuel mixture can be ignited for driving the piston through the guide cylinder 8 toward the muzzle part 1. Combustion chamber 9 is cylindrical and is fixed in the first housing part 2. A cylindrical combustion chamber housing 10 defines the combustion chamber 9. Inside the combustion chamber housing 10 there is an annularly shaped combustion chamber wall 11 located next to the piston 7 and followed in the rearward direction by a plate shaped separation wall 12 and a plate shaped intermediate wall 13. The walls 11, 12 and 13 extend transversely of the axial direction of the combustion chamber 9. At the rear end of the combustion chamber housing 10 there is a rear wall 14. The walls, 11, 12, 13 are parallel to the rear wall 14 and can be moved towards or away from the rear wall. Further, these walls extend perpendicularly relative to the axial direction of the combustion chamber housing 10.

The front combustion chamber wall adjacent the piston 7, as shown in FIG. 1, has a through opening or aperture 15 which can be closed by the piston 7 or by a piston projection 7*a* extending rearwardly from the piston. Permanent magnets 7*b* serve for temporary retention of the piston 7, 7*a* at the combustion chamber wall 11, with the magnets located on the rear piston face directed towards the front of the combustion chamber wall 11. The permanent magnets 7*b* serve to retain the piston 7, 7*a* at the combustion chamber wall 11 during inactive periods of the device. Combustion chamber wall 11, through sealing rings in its outer circumferential surface, bears closely against the inside surface of the combustion chamber housing 10. The movement of the combustion chamber wall 11 in the driving direction is limited by a stop 10*a* at the front end of the combustion chamber housing 10. Stop 10*a* extends radially inwardly relative to the inside surface of the housing 10. An elastic ring 10*b* is held against the stop 10*a* and forms the bearing surface for the combustion chamber wall 11 at its position closest to the muzzle part 1.

In addition to its through aperture 15, the combustion chamber wall 11 has a waste gas passageway 16 capable of being closed by a floating check valve 17. Floating check valve 17 only permits a flow of gas out of the combustion chamber 9. To afford such flow, the combustion chamber wall 11 must be moved rearwardly away from the ring 10*b*.

Rearwardly of the combustion chamber wall 11 is the separation wall 12 subdividing the combustion chamber 9 into a front partial combustion chamber 9*a* adjacent to the piston 7 and a rear partial combustion chamber 9*b* adjacent to the rear wall 14. Separation wall 12 has its outer circumferential surface bearing tightly by means of sealing rings against the inner surface of the combustion chamber housing 10. Further, the separation wall 12 has one or more apertures 12*a* which can be closed by a check valve 12*b* in the form of a flexible valve plate. Check valve 12*b* is located on the front side of the separation wall 12 and can be lifted off a valve seat by a predetermined amount towards the combustion chamber wall 11.

The separation wall 12 and the check valve 12*b* serve to conduct an air-fuel mixture, already ignited in the rear partial combustion chamber 9*b*, in a radial direction into the front partial combustion chamber 9*a* for the optimum combustion of the air-fuel mixture. This arrangement is already known from U.S. Pat. No. 4,365,471.

In addition, spacer elements 12*c* are located on the front and rear surfaces of the separation wall 12. These spacer elements 12*c* assure an adequate venting of the individual chambers even when the walls 11, 12, 13 are pushed close to one another. The spacer elements afford the formation of venting channels between the walls.

Rearwardly of the separation wall 12 is the intermediate wall 13 located within the combustion chamber 9 and dividing the rear partial combustion chamber 9b into a first partial rear combustion chamber 9c and a second partial rear combustion chamber 9d. The first partial rear chamber 9c is located rearwardly of the second partial rear chamber 9d. The first rear partial chamber 9c is connected with a passageway 10d for supplying the air-fuel mixture into the combustion chamber 9. Accordingly, intermediate wall 13 is located between the separation wall 12 and the rear wall 14 and has through openings 13a in its outer circumferential region, whereby the first and second partial rear chambers 9c, 9d are in communication with one another. Several through openings 13a can be spaced equiangularly apart around the circumference of the intermediate wall 13. A recess 13b in the rear surface of the intermediate wall 13 serve to receive ignition electrodes 18a when the walls 11, 12, 13 are pushed together against the rear wall 14.

The rear wall 14 includes an ignition mechanism 18 including two ignition electrodes 18a which project into the first partial rear chamber 9c. With the air-fuel mixture in the first partial rear chamber 9c, the mixture is ignited by the ignition mechanism 8 when a trigger 19 in the handle is actuated. The ignition mechanism 18 will be described in detail later.

Figure 2:
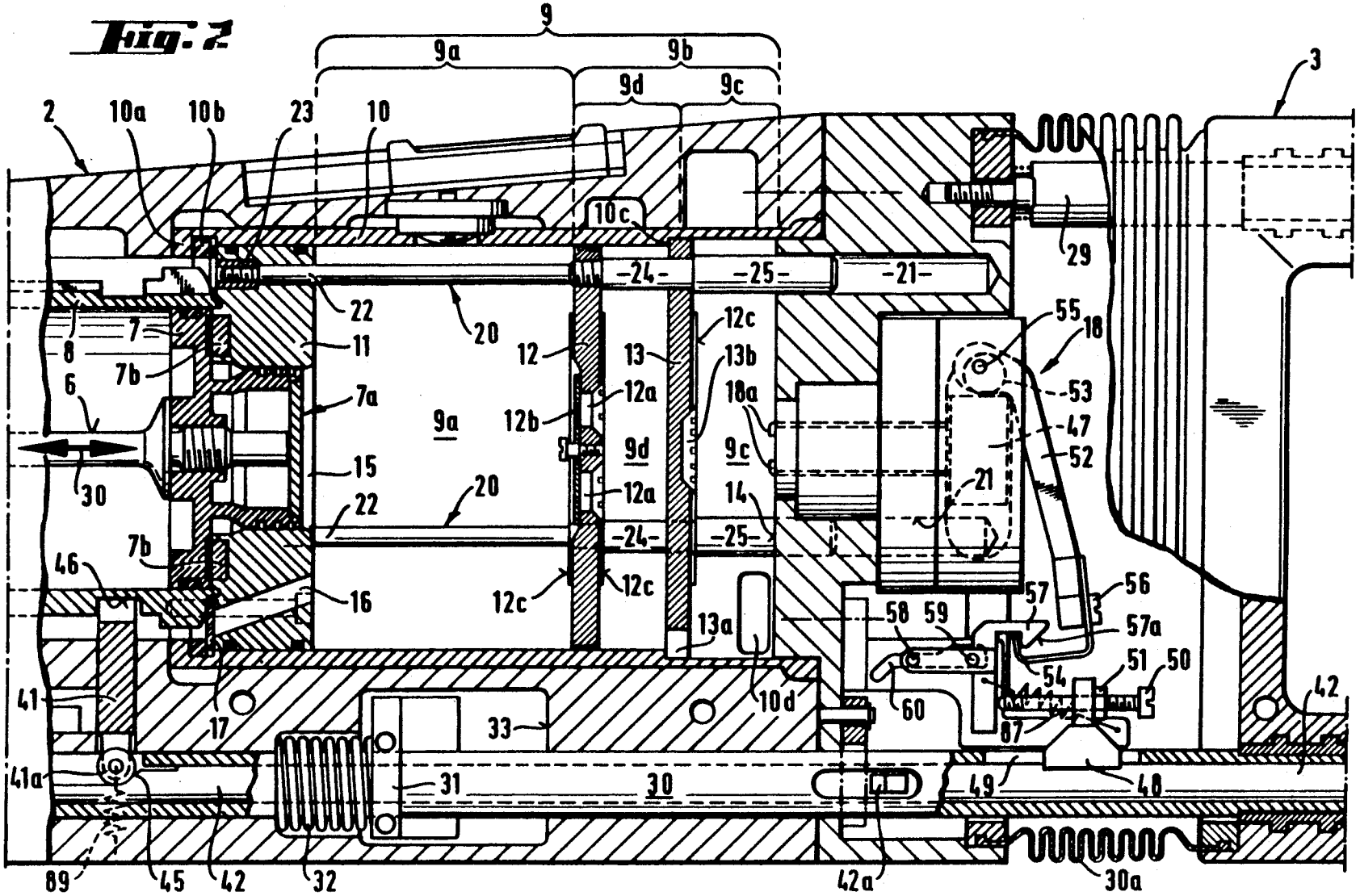
FIG. 2 is an enlarged detailed section of the axially extending part designated by a bracketed part II in FIG. 1.

As can be seen in FIG. 2, several axially extending guide rods 20 are located within the combustion chamber 9 for guiding the walls 11, 12, 13, as these walls move in the expanding condition or contracting condition of the combustion chamber. As an example, three guide rods 20 are arranged at equiangular spacings adjacent to the inner surface of the combustion chamber housing 10 and the rods extend parallel to the axial direction of the combustion chamber 9. The guide rods 20 are slidably supported in cylindrical recesses 21 in the rear wall 14 extending in the axial direction of the combustion chamber 9. In FIG. 2 the rods are partially axially displaced out of the recesses 21. Separation wall 12 is fixed to the guide rods 20 by a threaded arrangement located approximately mid-way between the ends of the guide rods 20. Accordingly, guide rods 20 and the separation wall 12 are displaceable as a unit in the axial direction of the combustion chamber housing 10. The combustion chamber wall 11 is slidably supported on an axially extending front section 22 of the guide rods, with the front sections 22 extending through corresponding bores in the outer radial region of the combustion chamber wall 11. An increased diameter part 23, such as a threaded sleeve or the like, is located at the front end of each section 22 for preventing the combustion chamber wall from sliding off the front sections 22 of the guide rods 20. The combustion chamber wall 11 can be moved in the axial direction along the front section 22 of the guide rods, that is, between the parts 23 and the separation wall 12.

Intermediate wall 13 is also axially slidably displaceable on the guide rods 20 along a guide rod section 24 extending from the separation wall 12 rearward toward the rear wall 14. The guide rod sections 24 extend through corresponding through apertures in the radially outer region of the intermediate wall 13. The displacement of the intermediate wall 13 away from the separation wall 12 is limited by another guide rod section 25 of larger diameter than the guide rod section 24. This rearward guide rod section 25 is slidably supported in the cylindrical recess 21. The displacement of the intermediate wall 13 toward the front of the device is limited by a stop or shoulder 10c in the inside surface of the combustion chamber housing 10. Stop 10c is formed by providing a larger diameter for the rear end part of the inner surface of the combustion chamber housing 10. As a result, the diameter of the circumference of the intermediate wall 13 is somewhat larger than the diameter of the separation wall 12.

The displacement of the walls 11, 12, 13 and of the guide rods 20 occurs by the displacement of the guide cylinder 8 whose rear end face is fixed to the front surface of the combustion chamber wall 11 around the piston 7. If the guide cylinder 8 is driven forwardly in the axial direction, then the combustion chamber wall 11 moves in the same direction. A portion of the guide cylinder 8 can move co-axially into and out of the combustion chamber 9.

The guide cylinder 8 has an elastic braking device 28 at its front end for braking the forward movement of the piston 7. Rows of through apertures 26, 27 are located through the guide cylinder 8 in the front end region thereof axially offset relative to one another. The purpose of these apertures will be described later.

As mentioned above, the second housing part 3 including the handle is attached to the rear end of the first housing part 2 so as to be movably displaceable relative to the first housing part. The relative movement between the two housing parts permits the volume of the combustion chamber 9 to be completely opened. The relative motion between the second housing part 3 and the first housing part 2 is in a direction parallel to the axial direction of the combustion chamber housing 10 and parallel to the setting direction of the piston, and, therefore, parallel to the axial direction of the guide cylinder 8. Accordingly, the volume of the combustion chamber 9 is increased if the second housing part 3 is moved toward the first housing part 2. To explain this movement more precisely, the second housing part 3 is connected by tubular shaped elements 29, 30 with the first housing part 2 with a free region between the first and second housing parts 2, 3 enclosed by a bellows 30a. The tubular shaped elements 29, 30 are displaceable in the axial direction counter to a spring force and the axial movement of the tubular shaped element 30 is transmitted by a gear train G to the guide cylinder 8.

The tubular shaped element 30 extends parallel to the axis of the combustion chamber 9 and has its rear end fixed in the second housing part 3. The front end of the tubular shaped element 30 is axially displaceable in the first housing part 2. Approximately in the middle region between the ends of the element 30 there is a latch 31 fixed to the element and a spring 32 presses the latch in the rearward direction toward the second housing part 3. The spring 32 abuts at an extension of the first housing part 2. Spring 32 serves to bias the tubular shaped element 30 rearwardly for displacing the handle on the rear housing part away from the first housing part. The rearward motion of the tubular shaped element 30, and of the latch 31 connected with it, is limited by a stop 33 in the first housing part 2, note FIGS. 1 and 2. The front end of the tubular shaped element 30 is fixed to a trolley 34, so that the trolley is moved along with the displacement of the tubular shaped element 30. Trolley 34 supports a rotary axis 35 extending perpendicularly of the axial direction of the combustion chamber 9. The rotary axis 35 includes a first pinion 36 and a second pinion 37 fixed to it with the second pinion having a larger diameter than the first pinion. The first pinion meshes with a toothed rack 38 fixed to the first housing part 2, note FIG. 3, the larger second pinion 37, however, meshes with a tooth rack 39 fixed on the outer surface of the guide cylinder 8 and extending in the axial direction of the cylinder. The two toothed racks 38, 39 are parallel to one another.

If the second housing part 3 is moved towards the first housing part 2, the tubular shaped element 30 moves in the forward direction counter to the biasing force of the spring 32, so that the axis of rotation 35 on the trolley 34 executes a translatory motion in the forward direction due to the connection of the tubular shaped element 30 with the trolley 34. Accordingly, the smaller first pinion 36 meshes with the first toothed rack 38 and rotates counterclockwise, that is, towards the left in FIG. 3. At the same time, the larger second pinion rotates counterclockwise and moves the guide cylinder 8 via the second toothed rack 39. Both pinions 36, 37 are rigidly connected with the axis of rotation 35. As a result, guide cylinder 8 is displaced into its most forward position as shown in FIGS. 1–3, and at the same time the walls 11, 12, 13 are moved along with the guide cylinder 8 and open up the combustion chamber volume of-the combustion chamber 9.

If the second housing part 3 does not apply pressure upon the surface A because of the removal of the working device from that surface, then spring 32 biases the tubular shaped element 30 rearwardly and the axis of rotation 35 follows a corresponding translatory movement toward the rear. Both pinions 36, 37 rotate clockwise, whereby the guide cylinder 8 is moved rearwardly into the combustion chamber to the extent that the volume of the combustion chamber is reduced to zero. The guide cylinder 8 must be in the unlatched position which will be discussed later.

Figure 3:
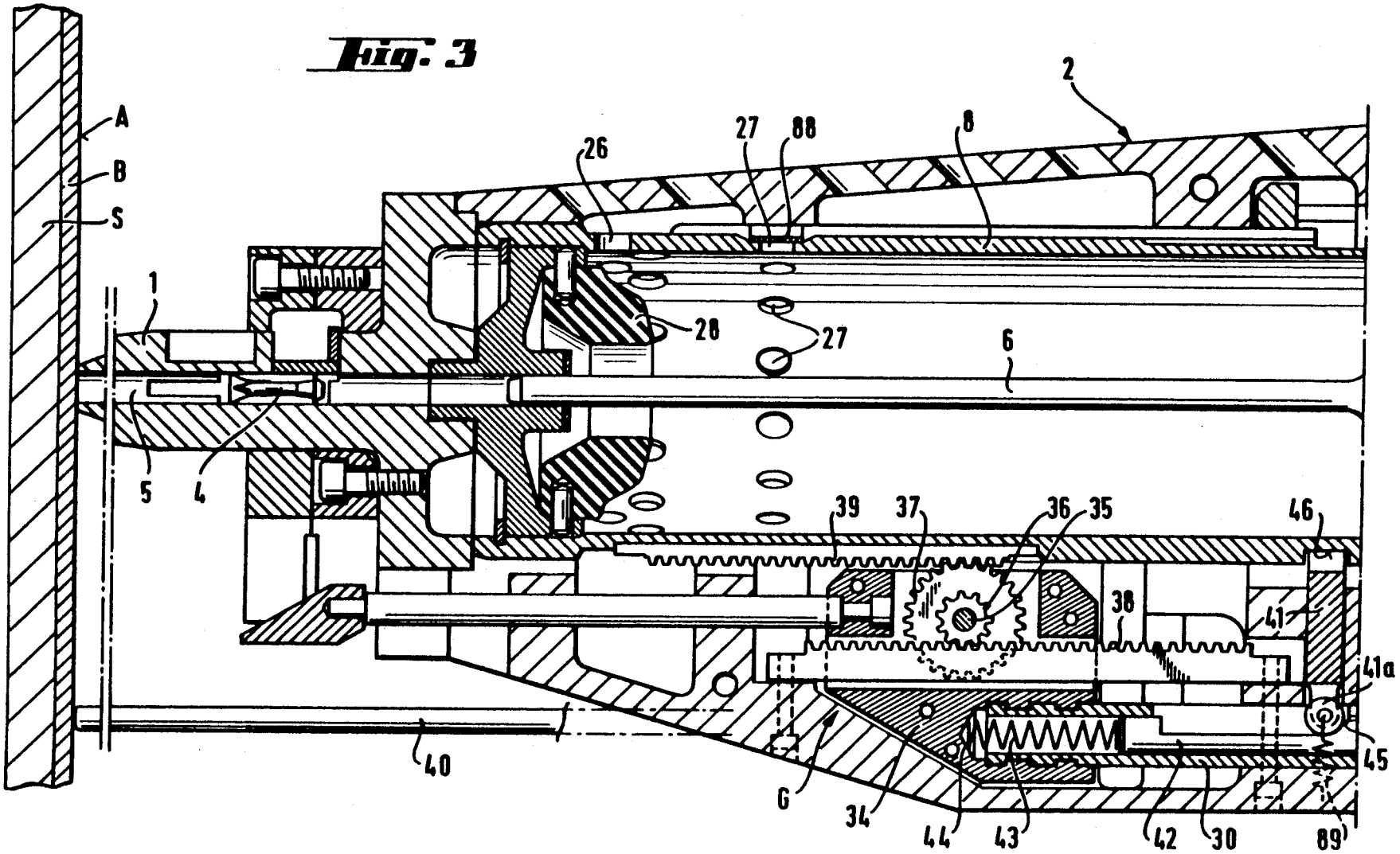
FIG. 3 is an enlarged sectional view of an axially extending part of the working device identified by a bracketed part III in FIG. 1.

Gear train G, note FIG. 3, includes the trolley 34, the axis of rotation 35, pinions 36, 37 and the toothed racks 38, 39, and is blocked when the working device is not being operated. In the non-operating condition the second housing part 3 and the first housing part 2 can not be moved towards one another and the combustion chamber can not be expanded. To unblock the gear train G, an unlatching rod 40 is provided projecting forwardly from the first housing part 2 and extending by a small amount beyond the front end of the muzzle part 1. The unlatching rod 40 extends parallel to the axis of the combustion chamber. It can be displaced counter to the biasing force of a spring **40*a* in the axial direction rearwardly into the first housing part 2, note FIG. 4. If the front end of the muzzle part 1 of the working device is pressed against the surface A, initially the unlatching rod 40 is pressed into the first housing part 2 for unlatching the gear train G by means of a slider 61 shown in FIG. 4. With the gear train G unlatched, it is possible to displace the second housing part 3 toward the first housing part 2 and to open up the combustion chamber 9. Slider 61, biased radially inwardly by the spring 61*b*, is contacted by a frusto-conical section 40*b* on the rod 40 when the rod is pressed radially inwardly, with the slider being moved radially outwardly for unlatching the gear train G. After the working device has been used, initially the second housing part 3 is moved away from the first housing part 2, subsequently the gear train G is again latched by the latching mechanism with the unlatching rod 40 moving forwardly with its leading end projecting beyond the front end of the muzzle part 1 by a given amount. In this circumstance, the slider 61 moves radially inwardly and engages in a detent groove 61*a* in the trolley 34, note FIG. 4**.

Another guide cylinder latching device is provided for preventing the guide cylinder from moving into the front combustion chamber **9*a* during ignition of the air-fuel mixture or towards the combustion chamber wall 11 directly after the return of the piston 7. This latching arrangement comprises a radially extending latching member 41 and a latching rod 42 extending in the axial direction of the combustion chamber. Latching rod 42 is supported so that it slides within the tubular shaped element 30 and projects beyond the rear end of the element, note FIG. 1. Furthermore, the latching rod 42 is displaceable against the force of a spring 43 located between the front end of the latching rod 42 and a stop 44 in the trolley 34. Spring 43 is a compression spring and attempts to push the latching rod 42 rearward out of the tubular shaped element 30. The rear end of the latching rod 42 is contacted by an arm 19*a* of the trigger lever 19 and the trigger lever is rotatable about an axis 19*b*, note FIG. 1. If the trigger is pressed, such as by the index finger, it rotates clockwise around the axis 19*b* and the arm 19*a* displaces the latching rod 42 in the forward direction against the force of the spring 43. Trigger 19 arm 19*a* and axis 19*b* are supported in the second housing part 3** or in the handle.

Latching rod 42 has a shoulder 45 which presses the latching member 41 radially inwardly when the latching member runs up against the shoulder 45, note FIG. 2. As a result, latching member 41 is displaced into a groove 46 in the outer circumferential surface of the guide chamber 8. A roller **41*a* which runs up against the shoulder 45 can be fastened at the radially outer end of the latching lever 41 facing the latching rod 42**, for the reduction of friction.

FIGS. 1–4 show an operating condition where the volume of the combustion chamber 9 is at its maximum and where the guidance cylinder 8 is not yet latched. Such latching takes place, however, directly with the actuation of the trigger 19, since shoulder 45 rests very closely at the roller **41*a*. If the trigger is pressed in the position as illustrated, then initially the guide cylinder 8 is latched, before ignition is initiated, with further displacement of the latching rod 42 in the forward direction, in order to ignite the air-fuel mixture in the first partial rear combustion chamber 9*c*. Since ignition can occur only after the guide cylinder 8 is latched, this is only possible in the completely expanded position, since the groove 46 is located at the rear end region of the guide cylinder, and the air-fuel mixture in the combustion chamber 9 can not be ignited if the volume of the combustion chamber has not been increased to its maximum. In other words, no ignition is possible if the second housing part 3 has not been completely pressed against the first housing part 2**.

The ignition mechanism 18 includes a piezo-electrical unit 47 with a piezo crystal for supplying an electrical ignition voltage to the ignition electrodes, if pressure is applied to the crystal. Such ignition pressure is sufficient to produce an ignition spark between the ignition electrodes **18*a* for igniting the air-fuel mixture located in the first partial rear combustion chamber 9*c***.

To apply pressure to the piezo-electric unit 47, a cocking unit has been provided which can be actuated by an entrainment device or driver 48 fixed on the latching rod 42, note FIG. 2. Driver 48 extends laterally from the rod 42 through an opening 49 in the tubular shaped element 30 and the opening 49 is dimensioned in the axial direction of the element 30 so that movement of the latching rod 42 with respect to the tubular shaped element 30 is not obstructed by the driver 48.

Driver 48 projects radially inwardly into the working device and is located in the region between the first housing part 2 and the second housing part 3. An adjustment of set screw 50, extending forwardly in the axial direction of the latching rod serves for setting the timing of the actuation of the cocking unit upon displacement of the second housing part 3 towards the first housing part 2. The screw 50 is connected with the driver 48. Adjustment screw 50 can be locked in position relative to the driver 48 by a lock nut 51.

As mentioned above, the cocking unit is located between the piezo-electric unit 47 and the driver 48 or the adjustment screw 50, whereby the cocking unit mechanically stresses and instantaneously unloads the piezo-electrical unit 47 when the latching rod is displaced by the trigger 19 to produce the ignition spark for igniting the air-fuel mixture.

As shown in FIG. 2, the cocking unit includes a cocking arm 52 having an upper end connected with an eccentric pin 53 and its lower end is connected to a hook 54. Cocking arm 52 is rotatable about an axis 55 located eccentrically in the pin 53. Hook 54 is secured at the lower end of the cocking arm by a screw 56. Hook 54 is U-shaped and it is fastened along one of its legs to the cocking arm 52. The other free leg located forwardly towards the muzzle part 1 runs approximately toward the axis of rotation 55. A claw-like arrangement 57 engages the free leg of the hook 54 from the top and carries the hook and the cocking arm 52 in the forward direction, if upon displacement of the latching rod in the forward direction the adjustment screw is also moved forwardly. Accordingly, cocking arm 52 is rotated clockwise around the axis of rotation 55, whereby the eccentric pin 53 applies pressure to the piezo-electric crystal. During this operation, the guide cylinder 8 is latched by the latching lever 41, since the lever has been pressed into the groove 42 due to the movement of the shoulder 45 against the roller 41*a*.

The claw-like arrangement 57 is guided in a slot 60 extending generally in the axial direction of the combustion chamber and it has two pins 58, 59 engaging in the slot whereby the arrangement 57 moves forwardly if the driver 48 is also moved forwardly and the cocking arm 52 is rotated clockwise. The displacement of the claw-arrangement 57 initially occurs in the axial direction of the combustion chamber. At its forward end, the longitudinal slot 60 is angled obliquely forwardly and downwardly, so that if the claw-like arrangement is moved further in the forward direction, the guide pin 58 move obliquely radially outwardly relative to the combustion chamber axis. Due to this movement, the claw-like arrangement 57 is rotated counter clockwise so that the free leg of the hook 54 is exposed. The cocking arm can now move rapidly counterclockwise because of the mechanical tension, whereby a relatively large ignition voltage is generated at the ignition electrodes 18*a*.

The displacement of the claw-like arrangement 57 in the forward direction occurs counter to the force of a spring 87, so that the claw-like arrangement moves rearwardly in the direction toward the handle after corresponding rearward movement of the driver 48. The claw-like arrangement 57 grips against the free end of the hook 54 so that the cocking arm 52 can be cocked when the handle is again pressed when another fastening element is to be driven. To be able to slide over the free leg of the hook 54, a suitable bevel or inclined surface 57*a* is formed on the claw-like arrangement.

In the following, the supply of the air-fuel mixture to the combustion chamber is described in more detail based on the illustrations in FIGS. 4 and 5*a*–5*e*.

Figure 4:
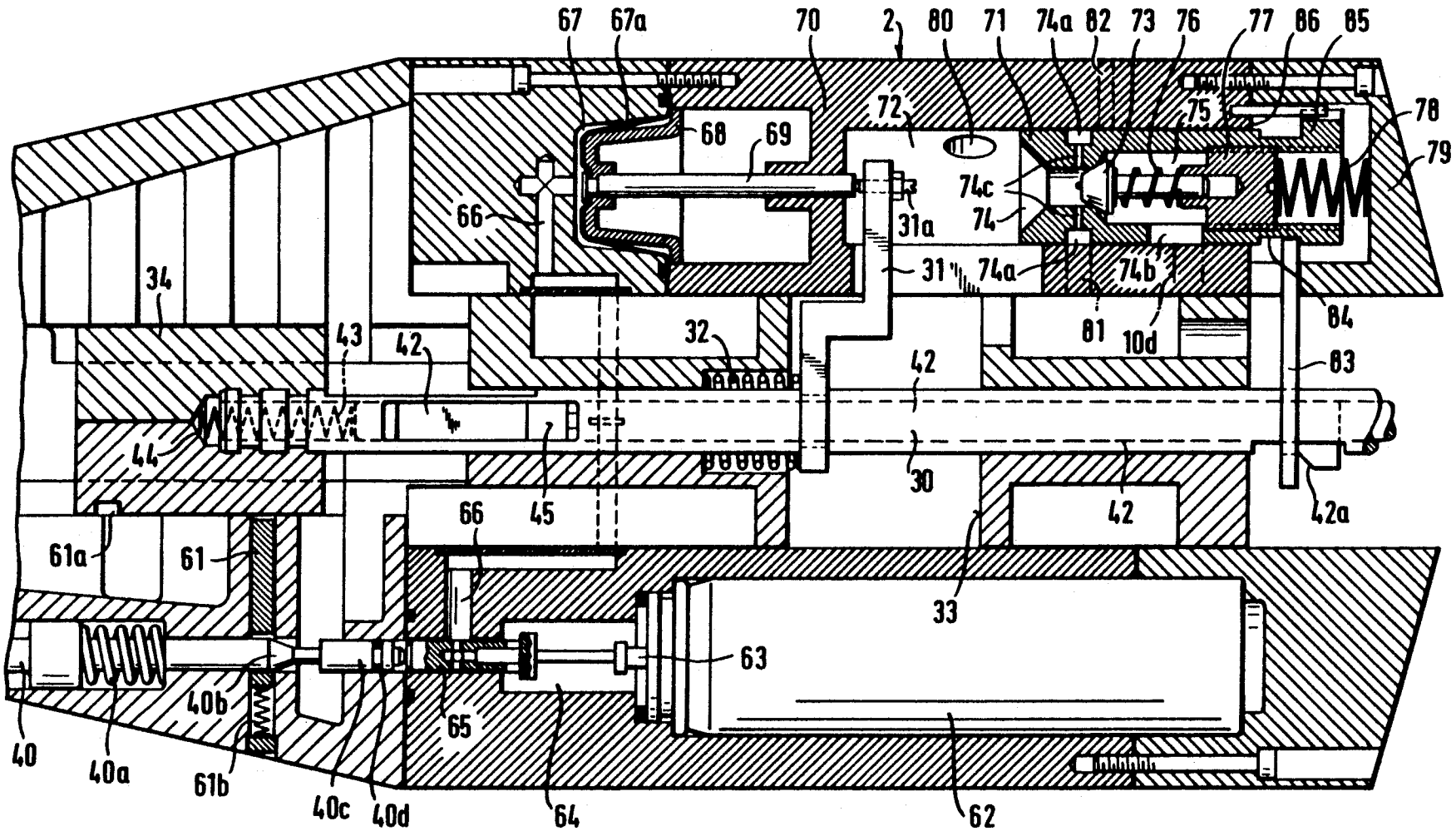
FIG. 4 is an axially extending sectional view of the working device in the region of its metering device taken along the line IV—IV in FIG. 1 and rotated through 90° relative to FIG. 1.

A container 62 of liquid gas is located within the first housing part 2 as shown in FIG. 4 and the container can be replaced when it is empty. The container can be a commercially available liquid gas container having a pressure operated outlet valve 63 at its front end.

Container 62 is connected with an apportioning chamber 64 through its outlet valve 63, wherein the liquified gas flows from the container 62 into the chamber 64 when the outlet valve is open. Furthermore, the apportioning chamber 64 has an outlet valve 65 so that the liquified gas can flow from the apportioning chamber 62 into a radially arranged gas channel 66.

As shown in FIG. 4, apportioning chamber 64 and container 62 are aligned with the unlatching rod 40. When the front end of the working device is pressed against the surface A, the unlatching rod 40 is pushed against the biasing action of the spring 40*a* into the first housing part 2 and the rearward end of the rod 40 contacts the outlet valve 65 of the apportioning chamber 64 and presses the valve in the rearward or right hand direction in FIG. 4. With such movement, the outlet valve 65 opens and, at the same time, the outlet valve 63 of the liquified gas container is closed. In this condition, liquified gas from the apportioning chamber 64 flows into the gas channel 66 and evaporates into the gaseous state.

If the working device is removed from the surface A, then the spring 40*a* displaces the unlatching rod 40 out of the first housing part 2 in the leftward direction in FIG. 4 so that the outlet valve 65 is moved to the left and closes under the action of its spring, not shown, simultaneously, the outlet valve 63 of the container 62 opens with such movement, so that the apportioning chamber 64 is again filled with liquified gas. To prevent escape of the evaporating gas from the channel 66 along the unlatching rod 40, the rod has a sealing ring 40*d* encircling its outer surface at the end adjacent to the apportioning chamber 64. The apportioning chamber 64 can be a recess within the first housing part 2.

The gas channel 66 is in flow communication with a metering chamber 67 containing a displaceable piston 68. Piston 68 is fixed to an axially extending piston rod 69 extending in a sliding manner through a wall 70 of the metering chamber and at its free or rear end it can be brought into contact with the latch 31. Latch 31 is fixed on the tubular shaped element 30. A set or adjustment screw 31*a* affords adjustment of the metering stroke.

In FIG. 4 the working device has the combustion chamber, note FIG. 2, opened as far as possible. If, as mentioned above, the pressing force is removed from the device handle, then the second housing part 3 moves away from the first housing part 2 and the latch 31 moves towards the right as viewed in FIGS. 1 and 2. In this non-operating condition of the working device, the latch 31 and the piston rod 69 are spaced from one another. In this non-operating condition, latch 31 presses against the front end of a hollow cylinder 71 and the cylinder is displaceable in a sliding manner within a cylindrical channel 72 towards the handle of the device, into the position shown in FIG. 5*a*.

Hollow cylinder 71 has valve unit 73 in its interior dividing its cylinder channel into an air suction channel 74 and a combustion channel 75 located rearwardly of the channel 74. The valve unit 73 can be opened in the flow direction from the air suction channel 74 to the combustion chamber channel 75 counter to the force of the spring 76 abutting against a stub 77 screwed into the hollow cylinder 71. A spring 78 presses against the rear end of the stub 77 and abuts against a face of rear wall 79 of the cylinder channel 72.

Cylinder channel 72 has an opening 80 in its front region in communication with the ambient atmosphere. Air can flow into the air suction channel 74 through opening 80 if the valve unit 73 is opened. The air suction channel 74 has a radial feed aperture 74*c* and a radial combustion chamber channel aperture 74*b*. The combustion chamber channel 75 can be connected with the opening 10*d* into the combustion chamber through the combustion chamber channel aperture 74*b*. An annular space 74*a* encircling the outside surface of the hollow cylinder 71 serves for connecting a metering chamber channel 81 with a pressure compensation channel 82, note FIGS. 5*a*–5*e*, though not shown in FIG. 4. Pressure compensation channel 82 is open to the ambient atmosphere, while the metering chamber channel 81 is in connection with the metering chamber 67. Metering chamber channel 81 and pressure compensation channel 82 are spaced apart in the axial direction of the combustion chamber, with the pressure compensation channel 82 located closer to the rear end of the working device.

The movement of the hollow cylinder 71 in the axial direction of the cylinder is limited, on one hand, by a slide 83 moveable only in the radial direction towards the hollow cylinder. Slide 83 usually engages in a groove 84 in the outer circumference of the hollow cylinder 71 and the length of the groove in the axial direction affords a certain axial displacement of the hollow cylinder 71. If the hollow cylinder 71 is in its most rearward or right hand position as shown in FIG. 4, then the combustion chamber channel 75 is in connection with the opening 10*d* through the combustion chamber channel opening 74*b*, while, on the other hand, the annular space 74*a* and the pressure compensation channel 82 are in spaced relation. Further, the annular space 74*a* and the metering channel 81 are in connection with one another as shown in FIG. 5*d*.

If the slide 83 is displaced radially inwardly by displacement of the latching rod 42 in the forward direction, an ignition operation is initiated and the hollow cylinder also moves forwardly until a radially outer projection 85 at its rear end strikes against the cylinder channel extension 86. In this position, the combustion chamber channel 75 and the opening 10*d* along with the metering chamber channel 81 and the annular space 74*a* are in spaced relation to one another, note FIG. 5*e*.

It should be noted that a roll up diaphragm 67*a* is located in the metering chamber 67 and serves as a sealing element to prevent the gaseous fuel from flowing past the edge of the piston 68 into the region behind it.

The following describes in detail the operational mode of the working device.

Initially, the working device is in the non-operating condition with the walls 11, 12, 13 within the combustion chamber positioned against one another and also against the rear wall. In this condition, the guide cylinder 8 is displaced rearwardly, and, for the most part, is located inside the combustion chamber housing 10. The combustion chamber volume is essentially equal to zero. Further, the second housing part 3 is spaced at the maximum distance from the first housing part 2, and the gear train G is in the latched or locked position.

First, a fastening element 4 is placed in a predetermined location in the barrel 5. If the front end of the working device, that is, its muzzle part 1, is pressed against the surface A of the component B the unlatching rod 40 is pressed rearwardly into the first housing part 2 causing the unlatching of the gear train G and operation of the valves 63, 65. After the unlatching rod moves rearwardly, the front end of the muzzle part 1 presses against the surface A and the second housing part 3 together with the handle is moved towards the first housing part 2. With such movement, there is a displacement of the tubular shaped element 30 so that the guide cylinder 8 is pulled out of the combustion chamber 9 by the gear train G. The transmission ratio of the gear train G is selected so that, after the second housing part 3 has been completely displaced, the guide chamber 8 is fully pulled out of the combustion chamber and arrives in its forwardmost position as shown in FIG. 1.

With the displacement of the guide cylinder 8 out of the non-operating position, the combustion chamber wall 11 is moved in the forward direction until it strikes against the widened parts 23 on the guide rods 20. In the forward movement of the guide cylinder 8, the guide rods 20 are moved forwardly and with them the separating wall 12. Next, the intermediate wall 13 is moved forwardly and is pushed along by the guide rod sections 25 of larger diameter. The movement of the walls 11, 12, 13 in the forward direction toward the muzzle part 1 is continued until the combustion chamber wall 11 strikes against the elastic ring 10*b*, and at the same time, the floating check valve 17 is closed. The floating check valve 17 is tightly closed when the combustion chamber wall 11 bears against the elastic ring 10*b*. Furthermore, the forward movement of the intermediate wall 13 is limited by the stop 10*c*.

The collar-shaped spacer elements 12*c* on the front and rear surfaces of the separation wall 12 prevent complete contact of the plates 11, 12, or 12, 13 with one another to avoid adhesion of these plates due to the presence of the residual moisture within the combustion chamber. In addition, the spacer elements also serve for forming venting channels when the combustion chamber 9 is reduced to its smallest volume so that it can be completely vented.

As the unlatching rod 40 is pressed inwardly or rearwardly into the first housing part 2, simultaneously, the metering chamber 67 is filled with gaseous fuel as described above with the fuel having been evaporated in the gas channel 66 after the fuel flows out of the apportioning chamber 64.

Figure 5A:
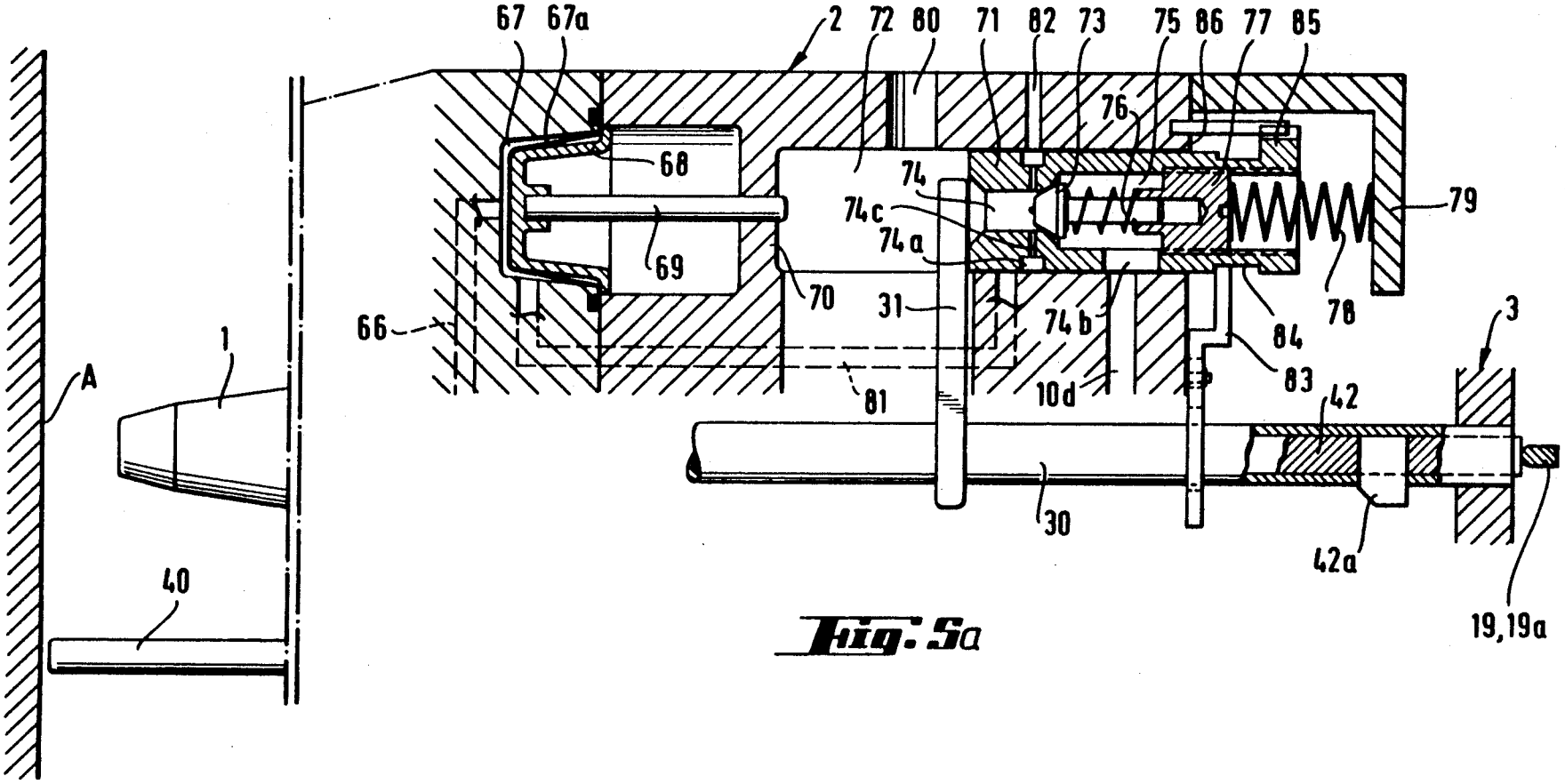
FIGS. 5*a*–5*e* are sectional views of different operating states of the working device as the combustion chamber is filled with an air-fuel mixture.

The initial position of the piston 68 in the metering chamber 67 at the outset of the rearward movement of the unlatching rod 40 is shown in FIG. 5*a*. In this condition, the latch 31 is spaced from the rear end of the piston rod 69.

Figure 5B:
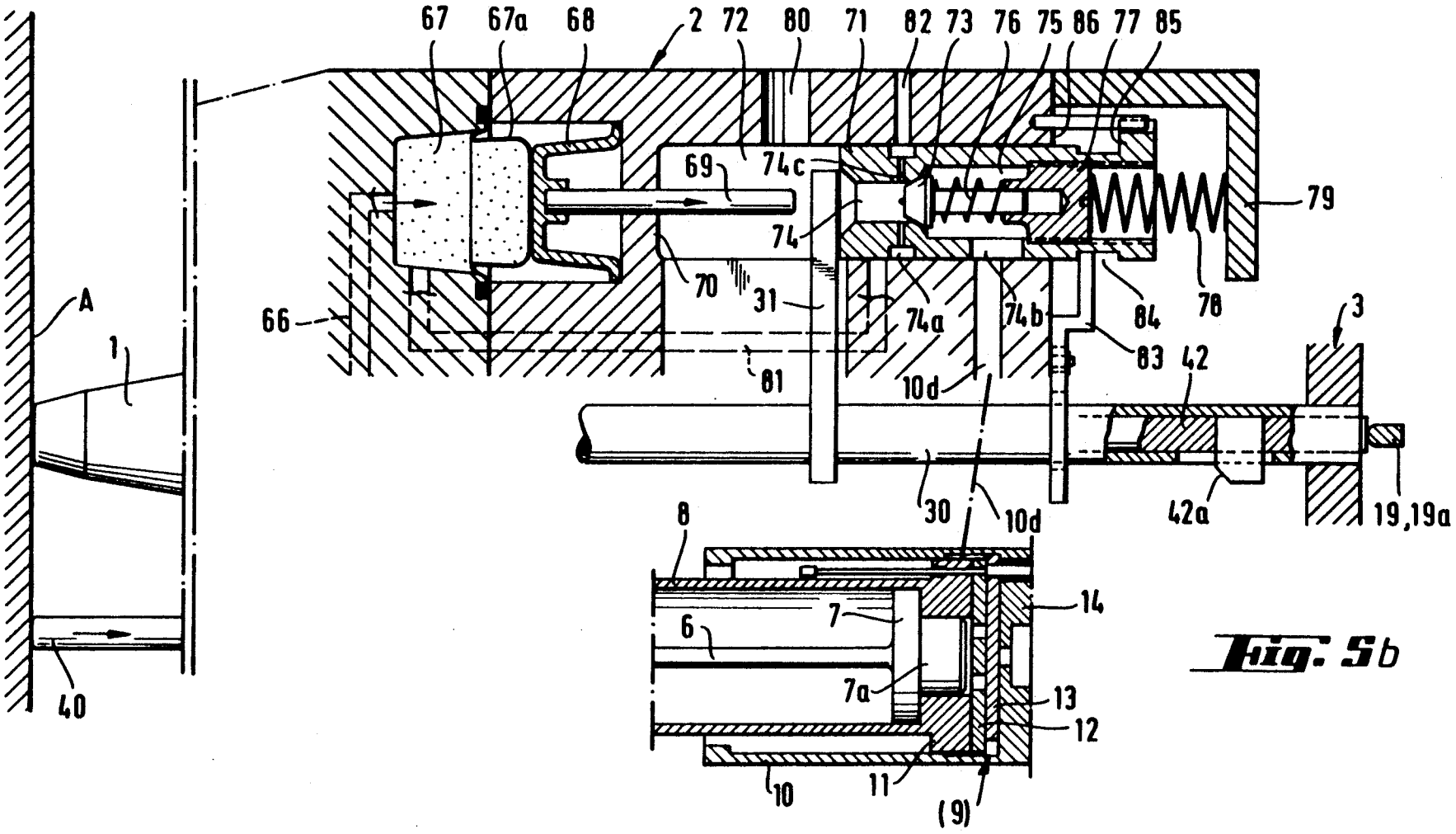
Figure 5C:
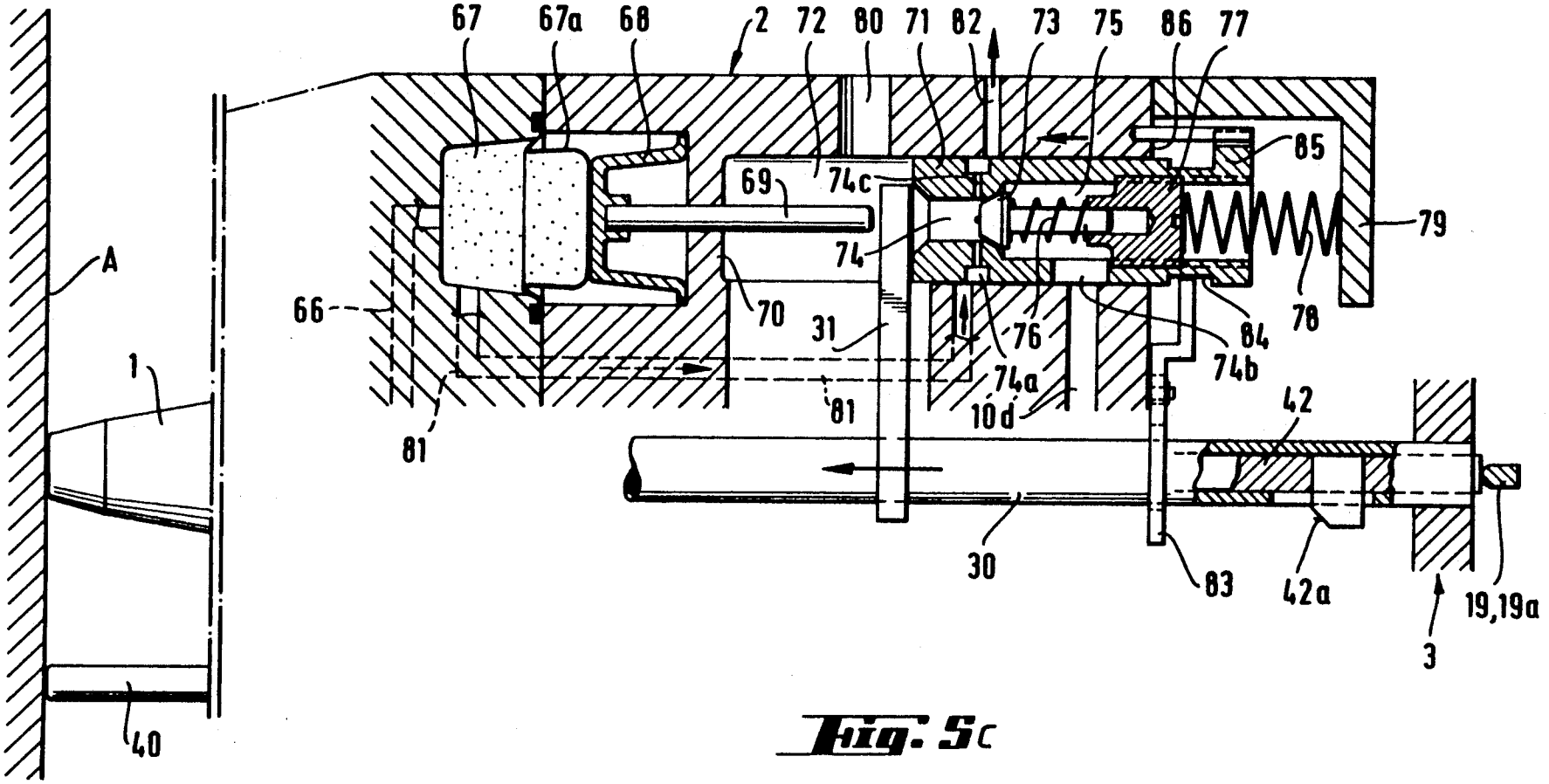
Figure 5D:
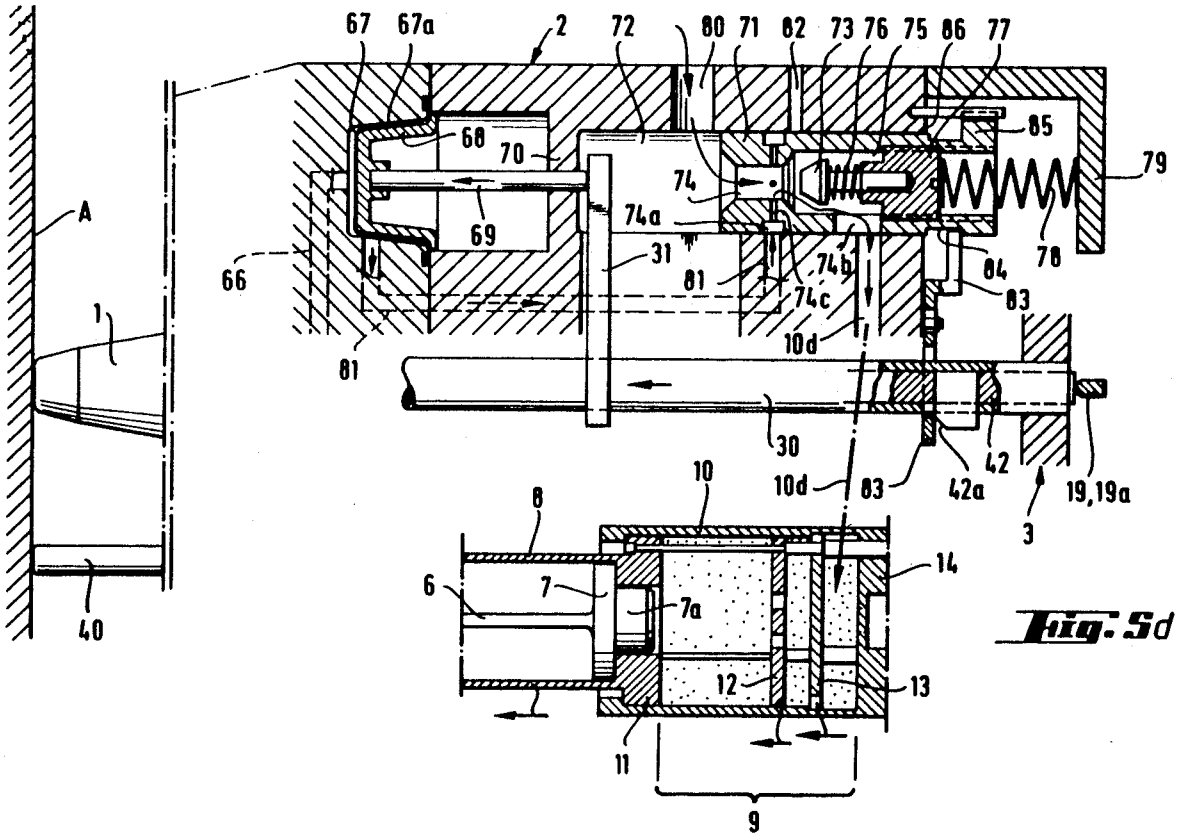
Figure 5E:
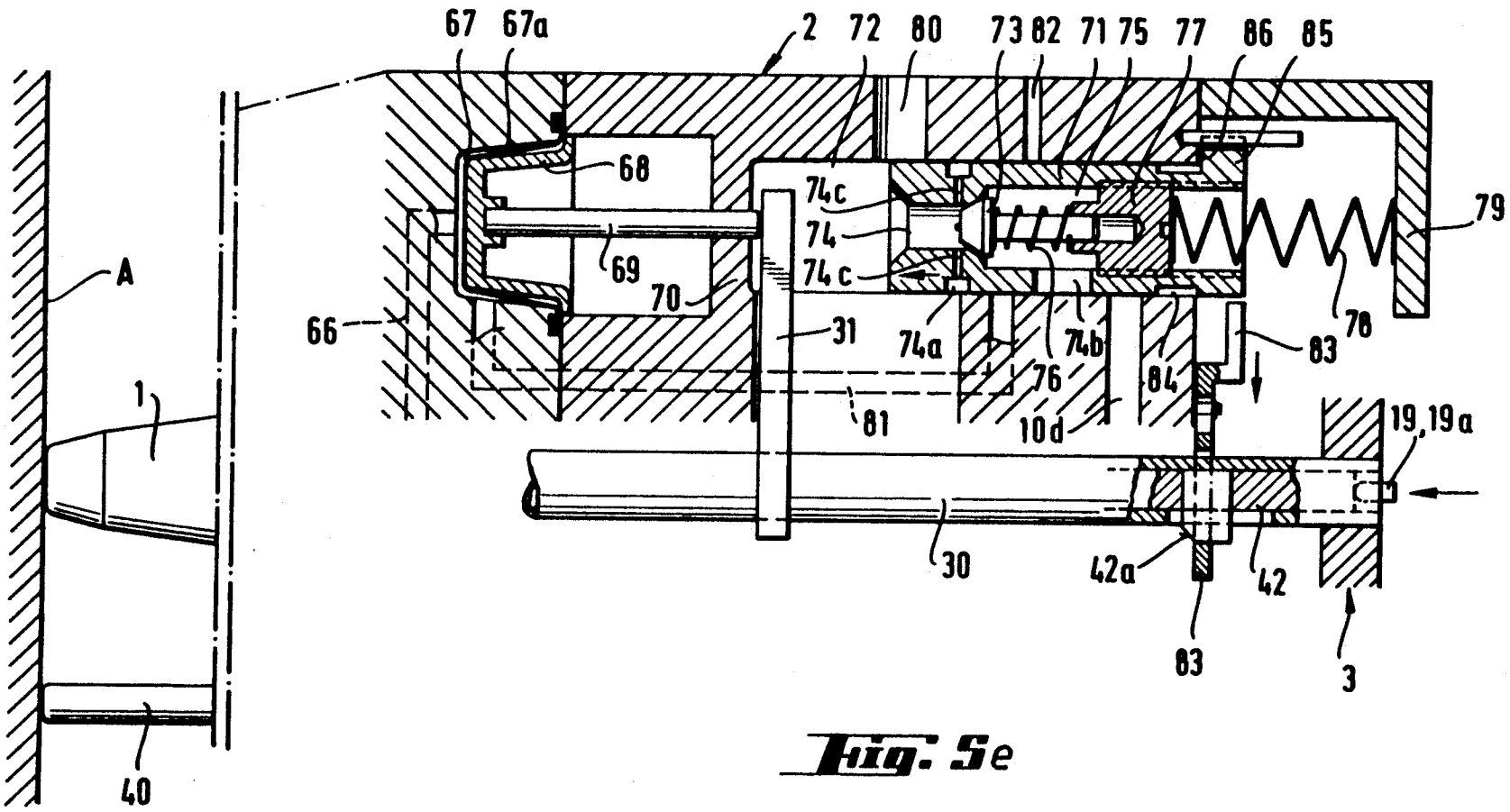

After the unlatching rod 40 has been completely pressed into the first housing part 2, and after the evaporation of the liquid gas in the gas channel 66, the piston is moved in the direction toward the hollow cylinder 71 or the latch 31 by the generated gas pressure, note FIG. 5*b*. The volume of the metering chamber 67 is increased, so that a specific quantity of the gaseous fuel can enter into the metering chamber 67. The metering chamber space is bounded, in addition to other surfaces, by the above mentioned roll-up type diaphragm 67*a*. The displacement of the piston 68 or the opening up of the metering channel volume occurs at a point in time when the handle has not yet been pressed forwardly, note FI. 5*b*. The latch 31 is still in the off position, whereby the hollow cylinder 71 is pressed by the spring 78 against the latch 31. As can be seen in FIG. 5*b*, the piston rod approaches but does not contact the latch 31, so that a certain spacing remains between them.

In the condition shown in FIG. 5*b*, the working device has been pressed against the surface A, however, the handle or the second housing part 3 has not yet been moved in the forward direction. If the second housing part 3 is moved towards the first housing part 2, then the latch 31, note FIG. 5*c*, moves in the forward direction. With displacement of the latch 31 in the forward direction, the hollow cylinder also moves, so that the metering chamber channel 81 enters into communication for a short period with the pressure compensation channel 82 by way of the annular space 74*a*. The gas pressure inside the metering chamber 67 is made equal to the ambient pressure, note FIG. 5*c*.

Upon further forward movement of the latch 31, see FIG. 5*d* the forward movement of the hollow cylinder is blocked by the slide 83 engaged in the groove 84. Annular space 74*a* is in connection only with the metering chamber channel 81 and not with the pressure compensation channel 82. At the same time, the combustion chamber channel 75 is in communication with the opening 10*d* through the combustion chamber opening 74*b*.

When the latch 31 is moved forwardly from the hollow cylinder 71, the piston rod 69 and the piston 68 are displaced in the forward direction reducing the volume of the metering chamber. The gas contained in the metering chamber 67 is pressed into air suction channel 74 through the metering chamber channel 81, the annular space 74*a* and the opening 74*c*. With the displacement of the tubular shaped element in the forward direction, the volume of the combustion chamber 9 is also increased and a negative pressure is produced in the combustion chamber, as mentioned above, since the combustion chamber is sealed against the ambient atmosphere. The negative pressure acts in the combustion chamber channel causing the valve unit 73 to open. Because of the negative pressure within the combustion chamber channel 75, the gaseous fuel is drawn into the chamber 75 and air is drawn in through the aperture 80 and the cylinder channel 72. As a result, the fuel and air form a turbulent mixture with one another and flow finally into the combustion chamber through the opening 10*d*, note FIG. 5*d*.

When the second housing part 3 has been pressed completely against the first housing part 2, the ignition process can be initiated by the triggering lever 19. If the triggering lever 19 is pressed, then the latching rod 42 moves in the forward direction toward the muzzle part 1. An impact bevel 42*a* fixed on the latching rod 42 projects through the tubular shaped element 30 and contacts the slide 83 and moves it radially outwardly out of the groove 84. The hollow cylinder 71 can now move further in the forward direction by means of the biasing action of the spring 78. The radially outwardly extending attachment 85 on the rear end of the hollow cylinder 71 strikes against the stop 86 and remains in the stopped position closing the combustion chamber opening 74*b*. Further, the hollow cylinder 71 also closes the metering chamber channel 81, so that the air-fuel mixture in the combustion chamber 9 can be ignited.

After the completion of the driving cycle, the working device is removed from the surface A and the latch 31 again moves in the rearward direction toward the handle and carries with it the hollow cylinder 71 into its original position where it is again latched or locked by the slide 83 which slide has moved radially inwardly shortly after ignition. The piston 68 remains in its forwardly displaced position until it is moved in the direction of the latch 31, note FIG. 5*a*, when the unlatching rod 40 is pressed rearwardly.

When the guide cylinder 8 and the walls 11, 12, 13 are again displaced in the forward direction, the combustion chamber is again increased between the Walls, 11–12 and 12–13, so that the negative pressure developed causes the air-fuel mixture to be drawn through the opening 10*d* in the first partial rear combustion chamber 9*c* and then into the full combustion chamber 9, as described above. The air-fuel mixture initially flows into the first partial rear combustion chamber 9*c* and then through the openings 13*a* into the second partial rear combustion chamber 9*d*. Due to the existing pressure relations, the check valve 12*b* in the separating wall 12 opens and the air-fuel mixture can flow through the openings 12*a* into the front partial combustion chamber 9*a*.

After the combustion chamber volume has opened up to its maximum, the groove 46 on the outer circumferential surface of the guide cylinder 8 is aligned above the latching lever 41, whereby the guide cylinder 8 can be latched if the trigger is actuated.

In this position, if the trigger is pressed, then initially the latching rod is moved forward by the arm 19*a* opposite to the biasing action of the spring 43. The roller 41*a* at the lower end of the latching lever 41 runs against the shoulder 45 and moves the latching lever into the groove 46. The guide cylinder 8 is locked in position and can not be moved in the forward or rearward directions. With continued pressing of the trigger, the opening 10*d* in the first partial rear combustion chamber is closed. With the latching rod 42 displaced forwardly, the driver 48 is also moved forwardly, and the cocking arm is rotated clockwise. Only after the shoulder 45 has completely pressed the latching lever into the groove 46, the guide pin 58 of the claw-like arrangement 47 arrives in the forward part of the guide slot 60 angled oblique outwardly for releasing the cocking arm so that it can rotate counterclockwise. A spark generated between the electrodes 18*a* ignites the air-fuel mixture in the first partial rear combustion chamber 9*c* so that the flame front propagates outwardly in the chamber 9*c*. This flame front reaches the second partial rear combustion chamber 9*d* through the openings 13*a* whereby the air-fuel mixture contained therein and also in the front partial combustion are recompressed. The flame front then reaches the check valve 12*b* and passes through the valve opening into the front partial combustion chamber 9*a* so that the air-fuel mixture contained therein is ignited in an explosive manner.

With the explosion of the air-fuel mixture, the piston 7 is accelerated forwardly towards the muzzle part 1 and the shank 6 drives the fastening element 4 out of the barrel 5 through the surface A.

Air located in front of the piston 7 within the guide cylinder 8 is discharged through the openings 26, 27 in the guide cylinder, preventing any braking action on the piston 7 caused by the development of an air cushion. If there is an excess of driving energy, for instance, if the fastening element is driven into a relatively soft component, the piston 7 strikes the elastic braking device 28 located at the front end of the guide cylinder 8.

After the piston 7 passes over the openings 27 the combustion gases present in the combustion chamber and in the guide cylinder rearwardly of the piston can flow out through the openings 27. Any remaining exhaust gas energy is conducted out of the working device through the openings 27. Openings 27 are provided with one way valves 88 preventing backflow, note FIG. 3.

Due to the expansion of the exhaust gas, the combustion chamber 9 is cooled developing a negative pressure which draws the piston 7 back towards the combustion chamber wall 11. During this operation, the combustion chamber is sealed against the outside of the working device.

After the through opening 15 in the combustion chamber wall 11 has been closed by the piston 7 or its projection 7*a*, the guide cylinder 8 can be unlatched by releasing the trigger 19 so that it moves rearwardly in the axial direction. When the trigger 19 is released, the spring 43 presses the latching rod 42 rearward, so that the roller 41*a* on the latching lever 41 assisted by the spring 89 rolls off the shoulder 45 and the latching lever 41 is displaced radially outwardly, leaving the groove 46 and releasing the guide cylinder 8.

If pressure if released from the handle of the working device, the second housing part 3 is mechanically withdrawn rearward from the first housing part 2 due to spring pressure. This spring pressure is produced, among other things by the spring 32. A corresponding spring can also be located on the tubular shaped element 30. Finally, the claw-like arrangement against engages the hook 54. As a result, the tubular shaped element 30 is displaced rearwardly and, at the same time, the guide cylinder 8 is moved rearwardly into the combustion chamber 9 by the gear train G. In such rearward movement, initially the combustion chamber wall 11 is moved on the guide rods 20 which carries the piston 7 with it by means of the magnets 7*b*. For the commencement of the rearward displacement of the combustion chamber wall 11, the check valve 17 opens, whereby the exhaust gas can escape from the combustion chamber 9 through the exhaust gas passageway 16.

As the combustion chamber wall 11 continues to move rearwardly, the volume of the front partial combustion chamber 9*a* is reduced until the wall 11 strikes the separation wall 12 and moves it rearwardly. At this point, the guide rods 20 are moved in the rearward direction resulting in a reduction in the volume of the second partial rear combustion chamber 9*d*. When the separation wall 12 bears against the intermediate wall 13, the volume of the first partial rear combustion chamber 19 is also reduced and finally the combustion chamber volume is at least approximately zero. Exhaust gas in the first partial rear combustion chamber 9*c* flows, during the combustion chamber volume reduction, through the openings 13*a* into the second partial rear combustion chamber 9*d* and then through venting channels in the collar shaped spacer elements 12*c* and the check valve 12*b* and venting channels in the spacer elements on the front side of the separating wall 12 into the front partial combustion chamber 9*a* or directly through the exhaust gas passageway 16, if the combustion chamber wall 11 is already located at the separating wall 12. Check valve 12*b* can open even if the walls 11, 12 are next to one another. For this purpose the check valve 12*b* is to a slight extent recessed into the separating wall 12 so that sufficient opening tolerance is present.

By driving together the internal parts of the combustion 9, the chamber can be mechanically flushed. After all of the chamber walls, 11, 12, 13 reach their final rearward positions, the unlatching rod 40 is also unloaded and the gear train G is again blocked or latched. If the working device is operated in a horizontal position, then the sequences of movement of the handle or the second housing part 3 rearwardly and the forwardly directed movement of the unlatching rod 40 can be matched to one another by appropriate spring strengths. If the working device is used in a vertical position and operated with the muzzle part pointed downwardly, then in any case the unlatching rod is last to be unloaded when the device is lifted off the surface A with the completely retracted second housing part 3, and by use of the working device handle.

While specific embodiments of the invention have been shown and described in detail to illustrate the application of the inventive principles, it will be understood that the invention may be embodied otherwise without departing from such principles.

We claim:

1. Portable, internal combustion power operated setting tool for driving fastening elements into a receiving material, comprising a housing (2, 3), an axially extending combustion chamber (9) within said housing, an axially extending piston (7, 7*a*) guided within an axially extending guide chamber (8) and at least an axially extending part of said guide chamber being mounted within said combustion chamber and being axially displaceable therefrom, said piston can be driven axially within said guide chamber by gas pressure generated by the combustion of an air-fuel mixture within said combustion chamber, and means connected to said combustion chamber for preparing the air-fuel mixture, wherein the improvement comprises that said combustion chamber is defined by an axially extending cylindrical housing, said combustion chamber housing has a rearward end and a forward end spaced apart in the axial direction, means within said combustion chamber for varying the combustion chamber volume including at least one combustion chamber wall (11) located within said extending transversely of and displaceable in the axial direction of said combustion chamber housing, said at least one combustion chamber wall (11) being axially displaceable within said combustion chamber housing between a non-operating condition adjacent the rearward end of the combustion chamber housing and an operating condition adjacent the forward end of the combustion chamber housing, said at least one combustion chamber wall (11) arranged to receive and readably hold said piston (7, 7*a*), a metering chamber (67) located within said housing for supplying a predetermined quantity of fuel, first means within said housing and in communication with said combustion chamber for supplying air and gaseous fuel into said combustion chamber, and the air-fuel mixture are drawn into the combustion chamber by increasing the combustion chamber volume and establishing a negative pressure therein.

2. Portable, internal combustion power operated setting tool, as set forth in claim 1, wherein said first means for supplying air and gaseous fuel comprises a liquid gas apportioning chamber (64) located in said housing upstream of said metering chamber (67), and said apportioning chamber receives liquid gas from a container (62) located within said housing.

3. Portable, internal combustion power operated setting tool, as set forth in claim 2, including second means displaceably mounted in said housing for flowing gas toward the metering chamber (67), when the setting tool is pressed against a structural component (B) and a liquid gas container outlet (63) is closed and an apportioning chamber outlet is opened and when the setting tool is lifted from the structural component, said second means effect closing of the apportioning chamber outlet (65) and opening of the liquid gas container outlet (63).

4. Portable, internal combustion power operated setting tool, as set forth in claim 3, wherein a pressure compensation channel (82) located within said housing can provide communication between said metering chamber (67) and the ambient atmosphere before filling the combustion chamber with the air-fuel mixture.

5. Portable, internal combustion power operated setting tool, as set forth in claim 1, wherein a metered amount of gaseous fuel from the metering chamber (67) is conveyed into an air suction channel (74) with an increase of the combustion chamber volume, and a valve arrangement located between the air suction channel (74) and the combustion chamber (9).

6. Portable, internal combustion power operated setting tool, as set forth in claim 4 or 5, wherein a latch (31) is fixed to said second means (30) for increasing the volume of the combustion chamber (9) and said latch arranged to displace a piston (68) within said metering chamber (67) to displace the gaseous fuel out of the metering chamber.

7. Portable, internal combustion power operated setting tool, as set forth in claim 6, wherein a hollow cylinder (71) located within said housing and containing a valve unit (73) and the air suction channel (74) and the hollow cylinder can be pressed against said latch (31 , said hollow cylinder having an annular space (74*a*) for connecting a metering chamber outlet (81) with a pressure compensation channel (82) offset from said metering chamber outlet (81) in the region of the said air suction channel (74), when said metering chamber (67) is empty and said hollow channel being displaceable in the direction of displacement of said latch (31) until said hollow cylinder (71) is stopped by a slide (83) after the pressure compensation channel (82) has been blocked.

8. Portable, internal combustion power operated setting tool, as set forth in claim 7, wherein said slide (83) releases said hollow cylinder (71) after latching said combustion chamber wall (11) and before igniting the air-fuel mixture contained in the combustion chamber (9), and said hollow cylinder has an extension (85) displaceable against a stop (86) on said housing (2, 3) for blocking said metering chamber outlet (81) and providing connection to said combustion chamber (9).

* * * * *